US007264227B2

(12) United States Patent
Miller et al.

(10) Patent No.: US 7,264,227 B2
(45) Date of Patent: Sep. 4, 2007

(54) SELF-CLIMBING STAGE LIGHT SUPPORT

(76) Inventors: John H. Miller, 3001 Old Salisbury Rd., Winston Salem, NC (US) 27127; Roger L. Zobel, 2692 Mill Ct., Doraville, GA (US) 30360

( * ) Notice: Subject to any disclaimer, the term of this patent is extended or adjusted under 35 U.S.C. 154(b) by 297 days.

(21) Appl. No.: 10/992,262

(22) Filed: Nov. 18, 2004

(65) Prior Publication Data

US 2005/0104053 A1 May 19, 2005

Related U.S. Application Data

(60) Provisional application No. 60/523,191, filed on Nov. 18, 2003.

(51) Int. Cl.
*B66D 1/26* (2006.01)

(52) U.S. Cl. ..... 254/331; 362/249; 362/250; 362/286; 362/386; 47/17

(58) Field of Classification Search ..... 254/331, 254/336; 362/145, 249, 250, 286, 386; 47/17
See application file for complete search history.

(56) References Cited

U.S. PATENT DOCUMENTS

| | | | | |
|---|---|---|---|---|
| 1,055,020 A | | 3/1913 | Camph | |
| 1,631,488 A | | 7/1927 | Jones | |
| 2,659,573 A | * | 11/1953 | Smith, Sr. | 242/379.1 |
| 3,558,102 A | | 1/1971 | Cruse | 254/93 |
| 4,195,332 A | | 3/1980 | Thompson | 362/391 |
| 4,228,488 A | | 10/1980 | Garchinsky | 362/250 |
| 4,324,386 A | | 4/1982 | Gagnon et al. | 254/288 |
| 4,358,817 A | | 11/1982 | Bielemeier | 362/386 |
| 4,429,355 A | | 1/1984 | Garchinsky | 362/403 |
| 4,438,903 A | | 3/1984 | Gagnon et al. | 254/269 |
| 4,455,961 A | * | 6/1984 | Hansen et al. | 114/254 |
| 4,606,527 A | * | 8/1986 | Ziller et al. | 254/336 |
| 4,661,894 A | | 4/1987 | Chenot | 362/391 |
| 4,662,628 A | * | 5/1987 | Chatenay epouse Compagnone | 472/77 |
| 4,949,959 A | | 8/1990 | Stevens | 272/123 |
| 5,003,442 A | | 3/1991 | Gallo et al. | 362/225 |
| 5,012,398 A | | 4/1991 | Jones et al. | 362/250 |
| 5,358,219 A | | 10/1994 | Shenk et al. | 254/269 |
| 5,556,195 A | | 9/1996 | Glebe | 362/386 |
| 5,664,865 A | | 9/1997 | Menke | 362/35 |

(Continued)

OTHER PUBLICATIONS

"Top Rail & Cyclorama System," A Gruppo Manfrotto Company, Issue No. N°3-04/01, 1993.

(Continued)

*Primary Examiner*—Emmanuel M Marcelo
(74) *Attorney, Agent, or Firm*—Thomas, Kayden, Horstemeyer & Risley, LLP

(57) ABSTRACT

A self-climbing stage lighting system having a self-climbing apparatus and a light bar is disclosed. The self-climbing apparatus is hung from cables that extend approximately vertically from a fixed endpoint. The self-climbing apparatus includes an elongated support member and a linear actuator that drives travels sheaves along a portion support member. Responsive to the travel sheaves being driven in a first direction, the self-climbing apparatus climbs cables. Responsive to the travel sheaves being driven in the direction opposite the first direction, the self-climbing apparatus descends the cables.

24 Claims, 8 Drawing Sheets

U.S. PATENT DOCUMENTS

| | | | | |
|---|---|---|---|---|
| 5,711,713 | A | 1/1998 | Krueger | 472/77 |
| 5,790,407 | A | 8/1998 | Strickland et al. | 364/474.11 |
| 5,915,673 | A * | 6/1999 | Kazerooni | 254/270 |
| 5,975,726 | A | 11/1999 | Latimer | 362/384 |
| 5,996,970 | A | 12/1999 | Auerbach | 254/288 |
| 6,155,696 | A | 12/2000 | Winton et al. | 362/250 |
| 6,261,122 | B1 | 7/2001 | Richter | 439/477 |
| 6,283,252 | B1 | 9/2001 | Lee | 187/291 |
| 6,312,139 | B1 | 11/2001 | Baker et al. | 362/145 |
| 6,520,485 | B1 * | 2/2003 | Soot | 254/331 |
| 6,547,220 | B2 * | 4/2003 | Johnson | 254/331 |
| 2001/0036077 | A1 | 11/2001 | Buss et al. | 362/287 |

OTHER PUBLICATIONS

"Top Suspension," A Gruppo Manfrotto Company, Issue No. N°4-04/01, 2000.

"Light Duty Self Climbing Hoist," DeSisti Lighting-Desmar Corp., Jul. 9, 1997.

* cited by examiner

SELF-CLIMBING STAGE LIGHT SUPPORT

CROSS-REFERENCE TO RELATED APPLICATION

This application claims priority to copending U.S. provisional application entitled, "SELF-CLIMBING STAGE LIGHT SUPPORT," having Ser. No. 60/523,191, filed Nov. 18, 2003, which is entirely incorporated herein by reference.

FIELD OF THE INVENTION

This invention concerns a support for light fixtures and other fixtures that are normally suspended above a stage of a theater or similar environment. More particularly, the invention concerns a light support that can be lowered to the level of the stage for adjustment and attachment of the fixtures that are carried by the light support and then raised to the proper height above the stage for illuminating the stage, etc.

BACKGROUND OF THE INVENTION

The support of overhead lighting systems in the environment of a theater stage is usually accomplished by mounting the light fixtures and other fixtures to an elongated horizontally oriented support beam. Usually, the light support beam can be lowered from above the stage down to the level where the technician can mount, adjust, replace, or otherwise maintain the lights and other fixtures. The support beam can then be raised to the desired elevated position for use in the stage production. Typically, the horizontal support beam is suspended at its ends by ropes or cables. In the older light supports the cables extended from the support beams upwardly to pulleys that were attached to the overhead structure of the building. In most cases, counterweights were attached to the cables to balance the load and the cables were controlled by a motor operated winch that is remotely positioned at the stage level. In many instances, the number of winches, cables, pulleys and other devices necessary to raise and lower the several light support beams was expensive and sometimes confusing to the technician, requiring the winches for each cable to be at the stage level, requiring a riser segment of the cable to extend upwardly from the stage to the overhead pulley, and then downwardly to the light support beam.

Another problem with the older stage light supports was that the pulleys that are attached to the overhead structure of the building are remote from the technician and from the operator, making inspection and replacement of the pulleys difficult. Yet another problem is the hazard of the sometimes heavy overhead equipment mounted on the stage light supports, and possibly overstressing the cables, pulleys, winches, or motors that are used to raise and lower the stage light supports. In some cases, these elements are positioned in remote locations, making it difficult for inspection, maintenance, repair, and replacement.

Later, stage light supports were constructed with motors and winches mounted directly to the light support, with each support cable requiring only one riser cable segment to extend from the ends of the light support to the overhead support structure. This eliminated the requirement for pulleys attached to the overhead structure and the segments of the riser cables that had to extend from the overhead pulleys down to the stage level and the previously required counterweights, etc. However, the newer light supports still had to include brakes for the cables to hold the light support in a fixed position, and the winch drums and brakes added weight to the assembly.

It would be desirable to provide a stage light support that has substantially all of its moving parts in one location, preferably on the stage light support itself, so that when the stage light support is lowered to stage level, its moving components can be inspected, maintained, etc. And, it would be desirable that the stage light support not be required to carry its own brakes and that a linear cable drive be employed for its cables to avoid the use of winches and their cable drums. It is to these features that this invention is directed.

SUMMARY OF THE INVENTION

Briefly described, the present invention comprises a self-climbing stage light support that includes an elongated support member or beam for mounting lights and other objects above a stage, and which includes it own motor, winch, and cables for raising and lowering the lights.

An embodiment of the invention includes a rectilinear tubular housing from which one or more light support beams are suspended for mounting the lights, etc. Cables are positioned at each end of the housing, with the upper ends or hanger portions of each cable being connected to the overhead structure of the stage, with the cables each extending downwardly to the opposed end portions of the tubular housing. The cables pass about stationary end sheaves mounted to the end portions of the tubular housing and extend along the length of the tubular housing to travel sheaves. The cable arrangement that extends about the travel sheaves is configured so that when the travel sheaves move along the length of the tubular housing, the cables at the opposed ends of the housing are simultaneously retracted back into the hosing or paid out of the housing, so as to raise or lower the tubular housing and the light fixtures, etc., mounted to the housing. The travel sheaves are controlled by a linear actuator, such as a travel screw. Upon rotation of the travel screw, the travel sheaves move along the length of the tubular housing, thereby paying out or retracting the cables from the opposite ends of the tubular housing.

In most instances, the configuration of the travel sheaves and the stationary end sheaves is such that several passes of the cable will pass about the sheaves so that a small movement of the travel sheaves results in greater movement of the cable paid out from or retracted into the ends of the tubular housing. For example, in a preferred embodiment of the invention, a one-foot movement of the travel sheaves results in four feet of movement of the cable being paid out of or retracted to the tubular housing.

In the embodiments illustrated, the motor that rotates the travel screw is mounted on one end portion of the tubular housing, known as the "motor end" and is connected to the transmission of the travel screw with a belt drive. The other end portion of the tubular housing has more returns of the cable an is known as the "fixed end."

Another preferred embodiment of the invention includes two cables at each end of the elongated support member that are arranged about stationary end sheaves and extend to travel sheaves positioned intermediate the end sheaves. This places a total of four hanger segments of the cables at the ends of the elongated support member for stability purposes, to avoid tilting of the elongated support member in response to a light fixture being offset from the elongated support member. Moreover, the use of two cables at each end of the elongated support member provides a safety factor such that if a cable should somehow become disconnected from the overhead of the stage structure, the other cable at the same end of the elongated support member can maintain the stage light support suspended above the stage, avoiding the falling of the light fixtures, etc.

DETAILED DESCRIPTION

Figure 1:
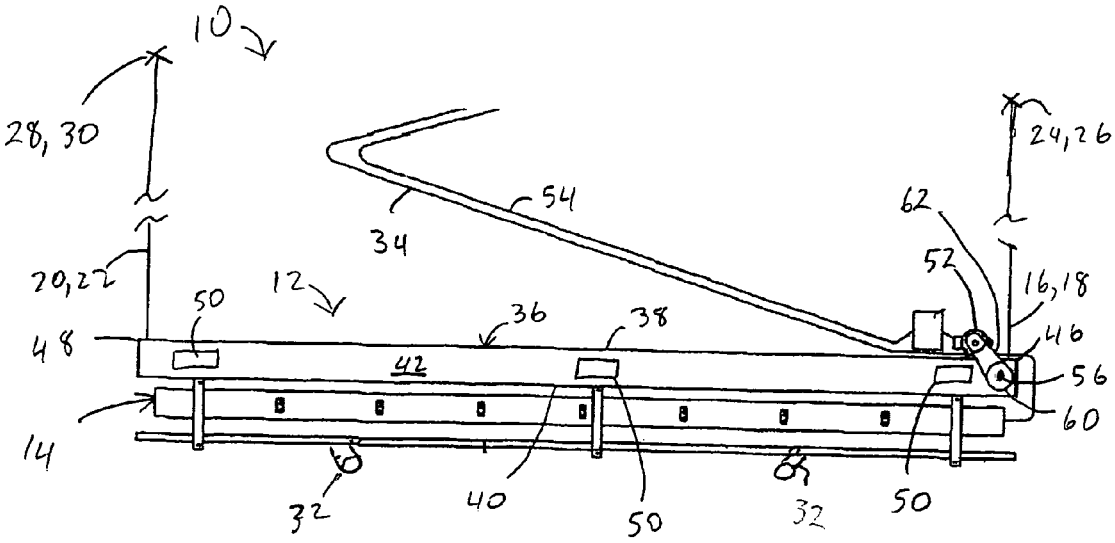
FIG. 1 is a side elevation view of a self-climbing stage light system.

FIG. 1 illustrates a self-claiming stage light system 10, which includes a self-climbing apparatus 12 having a longitudinal support member 36 in the form of a tubular housing and a light bar 14 suspended from the support member 36. The self-climbing apparatus 12 climbs cables 16 and 18 at one end of the support member 36 and climbs cables 20 and 22 at the other end of the support member 36. Each one of the cables 16, 18, 20, and 22 has an upper end that is denoted by 24, 26, 28, and 30, respectively, which are affixed to a stationary support such as the joists of a roof structure. Typically the lengths of cables 16, 18, 20, and 22 extending from the self-climbing apparatus 12 to their upper ends 24, 26, 28, and 30, respectively, are such that the self-climbing apparatus 12 is approximately horizontally aligned. However, as those skilled in the art would recognize, the lengths of the cables can be varied such that the self-climbing apparatus can be tilted with respect to horizontal. In addition, those skilled in the art would recognize that self-climbing apparatus can be adapted to climb fewer or more cables.

The light bar 14 is supported from the support member 36 of the self-climbing apparatus 12 and a plurality of stage lights 32 are attached to the light bar 14. The light bar is connected to a power supply (not shown) via an electrical connector 34. Those skilled in the art are familiar with lights bars, and consequently, it is not discussed in detail.

The self-climbing apparatus 12 includes the longitudinal support member 36, which is typically of tubular shape, such cylindrically shaped or rectangularly shaped in cross-section. However, in alternative embodiments, the support member 36 can be of open shape such as L-shaped or C-shaped in cross-section. Those skilled in the art would recognize that the cross-sectional shape of the longitudinal support member can be varied and that the above-mentioned cross-sectional shapes were provided for non-limiting exemplary purposes only. An embodiment of the support member 36 will be described in detail as being tubular with a square cross-sectional shape, but this is done only for the sake of clarity and is a non-limiting example. In one embodiment, the support member 36 includes a top wall 38, a bottom wall 40, and a pair of opposed front and back sidewalls 42 and 44 (see FIG. 2), respectively, extending therebetween. The support member 36 extends between a motor end 46 and opposed fixed end 48 of the support member 36.

The front sidewall 42 includes a plurality of access openings 50 for providing access to the inside of the support member. The back sidewall 44 can also include access openings if so desired. Similarly, the top wall 38 and the bottom wall 40 can also have access openings if so desired.

As shown in FIG. 1, a motor 52 is affixed to the top wall 38, proximal to the motor end 46 of the support member 36. The motor 52 is connected to a power supply (not shown) and a controller (not shown) via an electrical connector 54. A shaft 56 extends from the inside of the support member through a shaft opening 58 (FIG. 2) formed through the front sidewall 42. A pulley 60 is attached to the shaft 56, and the pulley 60 is coupled to the motor 52 via a V-belt 62. The shaft 56 is coupled to a drive mechanism that causes the self-climbing apparatus 12 to climb up and down the cables 16, 18, 20 and 22.

Figure 2:
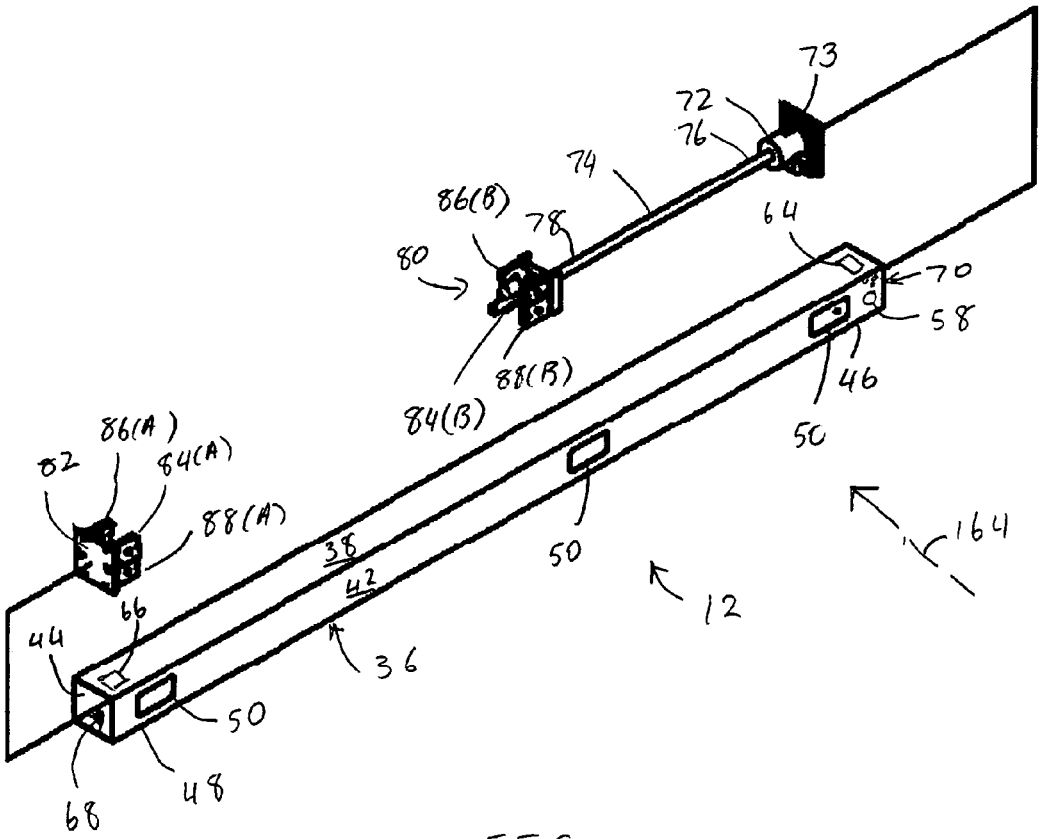
FIG. 2 is an exploded perspective view of a self-climbing apparatus with selected components of a self-climbing apparatus.

FIG. 2 shows selected components of the self-climbing apparatus 12 in exploded perspective form. The top wall 38 of the support member 36 includes a motor end cable opening 64 and a fixed end cable opening 66. Cables 16 and 18 (FIG. 1) extend through the motor end cable opening 64 and engage a first redirectional sheave (166 in FIG. 7A) and a second redirectional sheave (not shown),repsectively, that direct cables 16 and 18 toward the fixed end 48. Cables 20 and 22 (FIG. 1) extend through the fixed end cable opening 66 and engage a first stationary sheave (180 in FIG. 8A) and a second stationary sheave (not shown), repsectively, coupled to the support member 36 proximal to the fixed end 48.

The support member 36 also defines a hollow interior 68 (FIGS. 2 and 9) that extends the longitudinal length of the support member from motor end 46 to fixed end 48. The front sidewall 42 of the support member 36 defines a plurality of bolt openings 70, which are used for receiving bolts (not shown) for coupling a first redirectional sheave 166 (FIG. 7A) to the front sidewall 42. The back sidewall 44 also defines bolt openings for coupling a second redirectional sheave (not shown) to the back sidewall 44.

Figure 9:
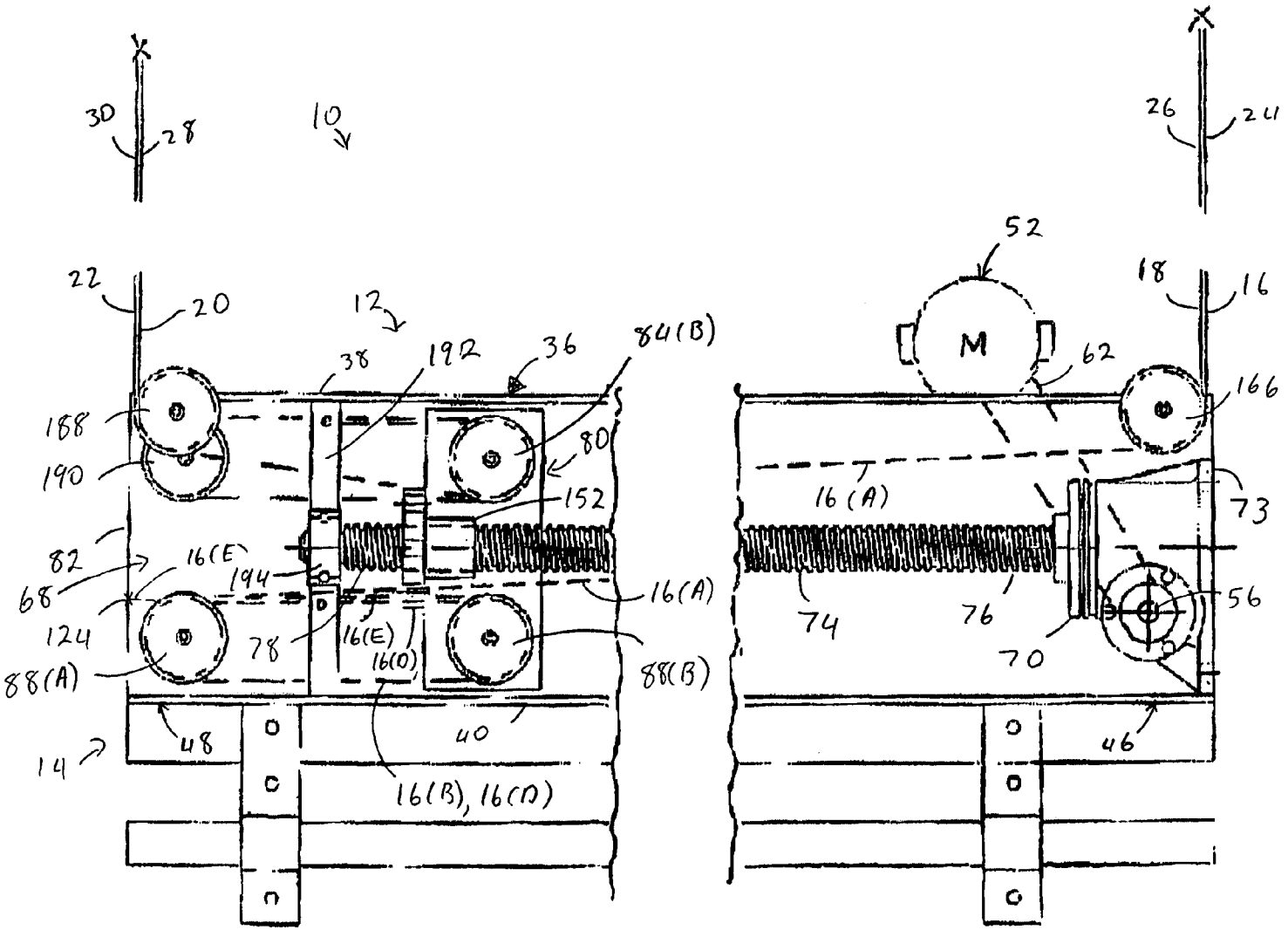
FIG. 9 is a side elevation view of the self climbing stage light system, with the intermediate portion of the device being removed to shorten the length thereof for illustrative purposes.

As shown in FIGS. 2 and 9, the self-climbing apparatus 12 further includes a travel screw transmission 72 that is powered by the motor 52 via the V-belt 62. The travel screw transmission 72 is coupled to a first end cap 73, which is configured to removably mate with the motor end 46 of the support member 36 such that in operable position the end cap 73 holds the travel screw transmission fixed within the support member 36.

As shown in FIG. 9, an externally threaded travel screw 74 extends from the travel screw transmission 72. The travel screw 74 includes a right end portion 76 and a left end portion 78. A travel member assembly 80 is coupled to the threads of the travel screw 74 and travels back and forth between the right and left end portion 76 and 78, respectively, of the travel screw 74 in response to the rotation of the travel screw 74. The travel screw transmission 72 is adapted to hold the travel screw 74 stationary when the travel screw transmission 72 is not being driven by the motor 52.

In one preferred embodiment, the motor 52 is a 208-volt, 60-hertz, 1750-rpm, reversible three-phase motor. The motor can be of other specifications. The transmission reduces the speed of the motor as it is applied to the travel screw. As will be understood from the following disclosure, the motor and the transmission cooperate to power the travel member assembly 80 such that the self-climbing apparatus 12 can climb and descend the cables at a rate of 10 vertical feet per minute.

Figure 4:
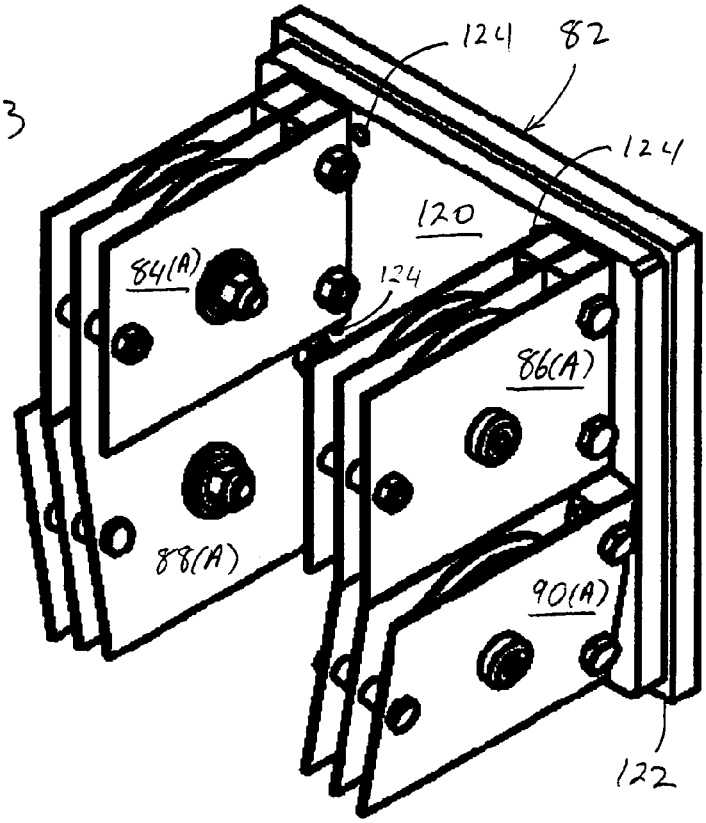
FIG. 4 is a perspective view of an end cap having a plurality double sheave blocks mounted thereon.

As shown in FIGS. 2 and 4, a second end cap 82 is adapted to couple to the support member 36 at the fixed end 48 of the support member. The end cap 82 has a plurality of double stationary or fixed sheave blocks of which 84(A), 86(A), 88(A) and 90(A) are visible. Similarly, the travel member assembly 80 includes a second plurality of double movable or travel sheave blocks of which 84(B), 86(B), 88(B) and 90 B are visible. In one preferred embodiment, the number of sheaves coupled to the end cap 82 equals the number of sheaves coupled to the travel member assembly 80. However, in alternative embodiments, the number of sheaves coupled to the end cap 82 and the number of sheaves coupled to the travel member assembly 80 may not be the same.

Before discussing the end cap 82 and the travel member assembly 80 in greater detail, a description of an exemplary double sheave block is provided. In one embodiment, the end cap 82 and travel member assembly 80 each include identical sheave blocks. (See FIGS. 2, 4 and 5.) However, in alternative embodiments, the sheave blocks coupled to the travel member assembly 80 can differ from the sheave blocks coupled to the end cap 82. In one embodiment, the sheave blocks coupled to the travel member assembly 80 differ from the sheave blocks coupled to the end cap 82 such that the cables 16, 18, 20, and 22 can be terminated on the travel member assembly.

Sheave Block

Figure 3:
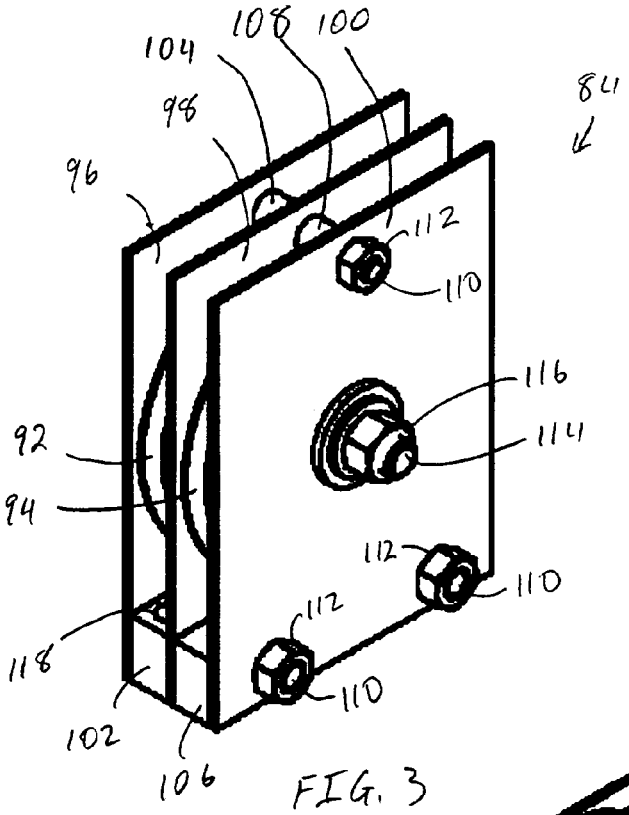
FIG. 3 is a perspective view of a double sheave block.

FIG. 3 is a perspective view of a double sheave block 84. In this embodiment, the double sheave block 84 includes two sheaves 92 and 94 and three sidewalls 96, 98, and 100. The sheave 92 is sandwiched by sidewalls 96 and 98, and the sheave 94 is sandwiched by sidewalls 98 and 100. A base block 102 and a spacer 104 interpose the sidewalls 96 and 98 such that the sidewalls 96 and 98 do not bind the sheave 92. Similarly, a second base block 106 and a second spacer 108 interpose the sidewalls 98 and 100 such that the sidewalls 98 and 100 do not bind the second sheave 94.

The sidewalls 96, 98, and 100 and the base blocks 102 and 106 each have a plurality of aligned holes (not shown) for receiving bolts 110. The spacers 104 and 108 are open ended cylinders such that the bolts 110 can extend through them. The bolts 110 are fastened with nuts 112. The sidewalls 96, 98, and 100 also define aligned axle openings (not shown) for receiving an axle bolt 114 that extends through the assembly of sidewalls 96, 98, and 100 and sheaves 92 and 94 such that the sheaves 92 and 94 can rotate about the axle bolt 114. The axle bolt 114 is held in place by a nut 116.

Each base block 102 and 106 also defines at least one internally threaded opening 118 for coupling with an externally threaded bolt. Typically, the internally threaded bolt openings 118 of base blocks 102 and 106 are juxtaposed. Thus, in the embodiment illustrated in FIG. 3, in the upper right hand portion hidden behind the sidewall 100, there is an internally threaded bolt opening in base block 106. The internally threaded openings 118 are used for coupling the double sheave block 84 to either the end cap 82 or to the travel member assembly 80. It should be remembered the sheave block described hereinabove is an exemplary, non-limiting, sheave blocks. In some embodiments, a sheave block includes more than two sheaves. However, in other embodiments, a sheave block may comprise only one sheave.

End Cap with Plurality of Sheave Blocks

Referring to FIG. 4, end cap 82 includes an inner wall 120 to which the double sheave blocks 84(A), 86(A), 88(A) and 90(A) are coupled. The inner wall 120 is sized and dimensioned such that it fits within the hollow interior 68 of the support member 36, and a circumambient flange 122 on the end cap 82 engages the end portions of the walls of the support member 36. The end cap 82 also defines a plurality of cable termination holes 124 through which bolts (not shown) are inserted to couple to ends of the cables 16, 18, 20, and 22 (not shown).

Double sheave blocks 84(A) and 86(A) are aligned approximately vertically and are disposed on the upper left hand side and upper right hand side (as viewed looking at the inner wall 120) of the interior wall 120, respectively. Disposed on the bottom left hand side, (as viewed looking at the interior wall 120) is a double sheave block 88(A); and disposed on the bottom right hand side (as viewed looking at the interior wall 120) is a double sheave block 90(A). The double sheave block 88(A) is tilted approximately 15° counter clockwise from vertical, and the double sheave block 90(A) is tilted approximately 15° clockwise from vertical.

Travel Member Assembly with Plurality of Sheave Blocks

Figure 5:
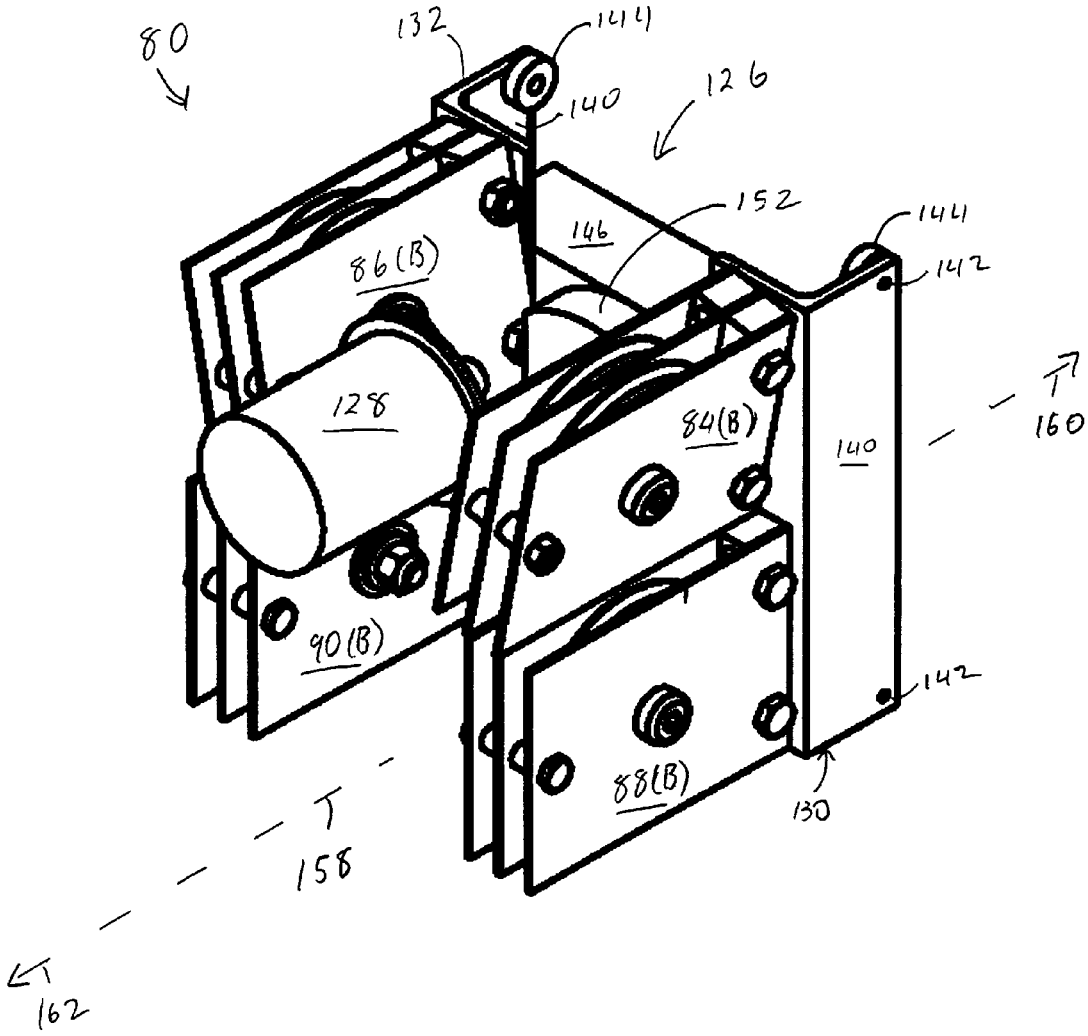
FIG. 5 is a perspective view of a travel member assembly.

Referring to FIG. 5, the travel member assembly 80 includes a travel member frame 126, a greaser 128, and double sheave blocks 84(B), 86(3), 88(B), and 90(B). The greaser 128 carries grease and applies grease to the travel screw 74 as the travel member assembly 80 traverses portions of the travel screw 74.

Figure 6:
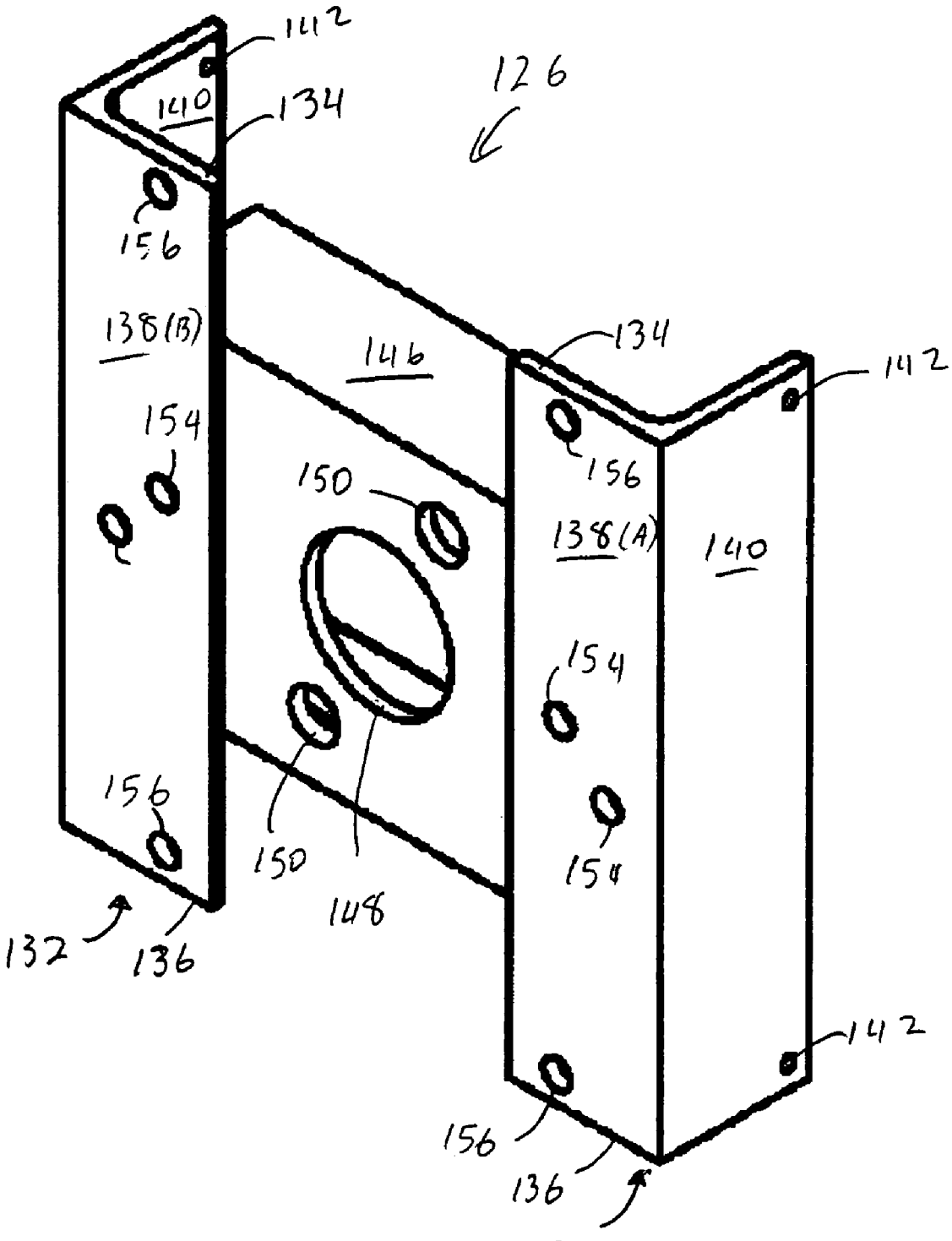
FIG. 6 is a perspective view of a travel member frame of the travel member assembly.

FIG. 6 illustrates the travel member frame 126 in greater detail. The travel member frame 126 includes two arms 130 and 132. Each of the arms has opposed ends 134 and 136 and the arms are approximately L-shaped in cross-section having walls 138 and 140. The lengths of the arms extending between the opposed ends 134 and 136 are such that the travel member frame 126 can fit within the interior 68 of the support member 36 with some free play. The walls 140 include holes 142 which are used to couple rollers 144 (see FIG. 5) to the arms 130 and 132. The rollers 144 engage the inside of the top wall 38 and the inside of the bottom wall 40 and prevent the travel member assembly 80 from rotating within the support member 36.

Referring to FIG. 6, a cross member 146 extends between the arms 130 and 132 such that the cross member overlies at least a portion of the walls 138(A) and 138(B). The cross member 146 is approximately rectangularly C-shaped in cross section with the opening of the C directed towards the travel screw transmission 72. The length of the cross member 146 is such that the width of the travel member frame 126 enables adequate clearance between arm 130 and front sidewall 42 for cables 16 and adequate clearance between arm 132 and back sidewall 44 for cable 18.

The cross member 146 defines a travel screw opening 148 and bolt openings 150. The travel screw 74 is adapted to fit through the travel screw opening 148. The holes 150 are used for bolting a travel nut 152 (see FIG. 5) to the cross member 146. The travel nut 152 (FIG. 5) is internally threaded and engages the external threads of travel screw 74, thereby causing the travel member assembly 80 to traverse portions of the travel screw 74 in response to the turning of the travel screw 74 by the screw jack transmission 72.

Referring to FIG. 6, arms 130 and 132 include bolt holes 154 and 156. The cross member 146 includes bolt holes (not shown) that are aligned with bolt holes 154. The bolt holes 154 and 156 are adapted to receive bolts (not shown) for bolting the double sheave blocks 84(B) and 88(B) to the arm 130 and the double sheave blocks 86(B) and 90(B) to arm 132, as illustrated in FIG. 5.

A dashed line 158 (see FIG. 5) represents the direction along which the travel member assembly 80 travels with arrows 160 and 162 pointing in the direction of the motor end 46 and opposed fixed end 48, respectively.

The double sheave block 84(B) is mounted to the arm 130 and is tilted approximately 15° clockwise (looking in the direction of arrow 160) from vertical. The double sheave block 86(B) is mounted to the arm 132 and is tilted approximately 15° counterclockwise from vertical. The double sheave blocks 88(B) and 90(B) are mounted approximately vertically to arms 130 and 132, respectively.

Cable Paths

As will become clear with the description of the cable paths in FIGS. 7A, 7B, 8A, and 8B, the alignment of the sheaves provides a good fleet angle for the cables between pairs of sheave blocks As shown in FIG. 2, double sheave blocks 88(A) and 88(B) are paired such that portions of cable 16 extend therebetween. Double sheave blocks 90(A) and 90(B) are paired such that portions of cable 18 extend therebetween. Double sheave blocks 84(A) and 84(B) are paired such that portions of cable 20 extend therebetween; and double sheave blocks 86(A) and 86(B) are paired such that portions of cable 22 extend therebetween.

Figure 7A:
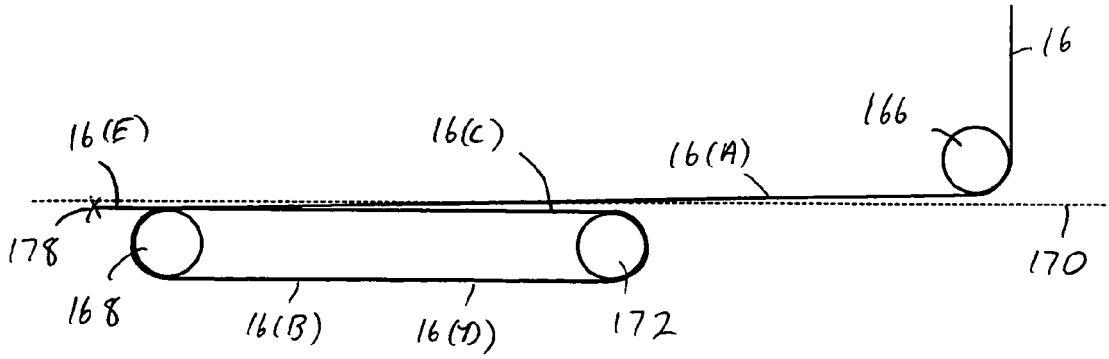
FIG. 7A is a side view of a first cable path for a first cable engaged by the self-claiming stage light system 10.
Figure 7B:
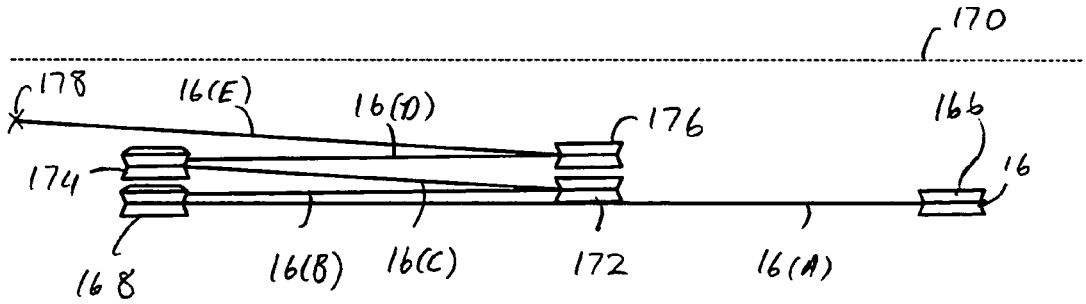
FIG. 7B is a top view of the first cable path for the first cable of FIG. 7A.

FIGS. 7A and 7B illustrate the cable path for cable 16 as viewed looking along the direction of arrow 164 (see FIG. 2) and from above, respectively. Cable 16 enters the support member 36 at the motor end 46 and engages a redirectional sheave 166 proximal to the motor end 46. A fixed length of cable 16(A) extends from the redirectional sheave 166 to a fixed sheave 168. A dashed line 170 represents the centerline of the support member 36. The fixed sheave 168 is the outermost sheave, as measured from the centerline 170, within the double sheave block 88(A) (see FIG. 4). The cable 16 wraps around the top of fixed sheave 168 to the bottom of fixed sheave 168, and a variable length of cable 16(B) extends from fixed sheave 168 to a travel sheave 172, which is the outermost sheave of double sheave block 88(B). The cable 16 wraps from the bottom to the top of travel sheave 172, and a variable length of cable 16(C) extends therefrom to the top of an inner fixed sheave 174 of double sheave block 88(A). The cable wraps from the top to the bottom of inner fixed sheave 174, and a variable length of cable 16(D) extends therefrom to the bottom of an inner travel sheave 176 of the double sheave block 88(B). The cable 16 then wraps from the bottom to the top of inner travel sheave 176, and a variable length of cable 16(E) extends to its termination point 178, which is coupled to the end cap 82. As the travel member assembly 80 traverses the travel screw 74, the variable lengths of cable 16(B), 16(C), 16(D), and 16(E) change accordingly. The redirectional sheave 166 does not translate with respect to the fixed end 48. Thus, the length of cable 16(A) is fixed. As those skilled in the art will recognize, the tilting of the double sheave block 88(A) with respect to the alignment of double sheave block 88(B) provides for a better fleet angle for the lengths of cable extending between the double sheave blocks 88(A) and 88(B) than if the double sheave blocks were similarly aligned.

Figure 8A:
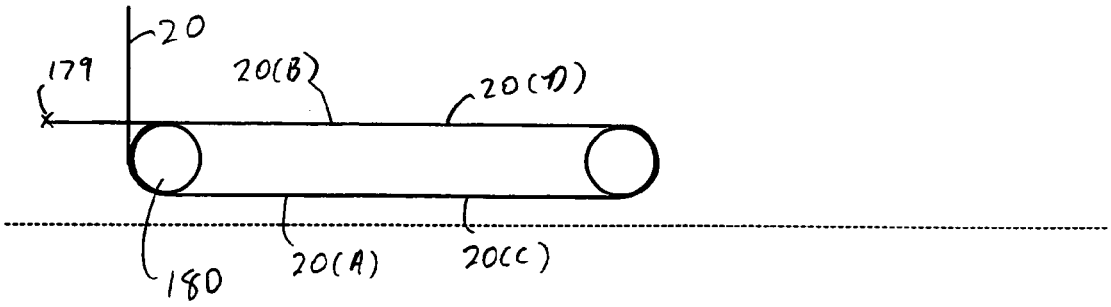
FIG. 8A is a side view of a second cable path for a second cable engaged by the self-claiming stage light system 10.
Figure 8B:
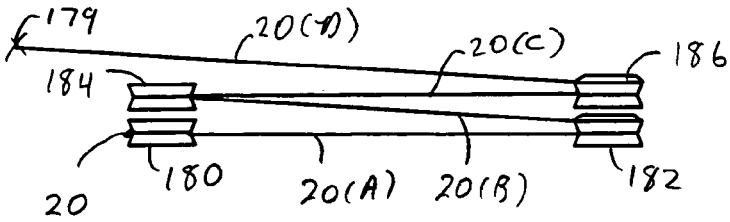
FIG. 8B is a top view of the second cable path for the second cable of FIG. 8A.

FIGS. 8A and 8B illustrate the cable path for cable 20 as viewed looking along the direction of arrow 164 (see FIG. 2) and from above, respectively. Cable 20 enters the support member 36 at the fixed end 48 and engages fixed outer sheave 180 of double sheave block 84(A). Sheave 180 is the outermost sheave of double sheave block 84(A), as measured from the centerline 170. The cable 20 wraps around fixed outer sheave 180, and a variable length of cable 20(A) extends from fixed outer sheave 180 to an outer travel sheave 182, which is the outermost sheave of double sheave block 84(B). The cable 20 wraps from the bottom to the top of outer travel sheave 182, and a variable length of cable 20(B) extends therefrom to the top of an inner fixed sheave 184 of double sheave block 84(A). The cable 20 wraps from the top to the bottom of inner fixed sheave 184, and a variable length of cable 20(C) extends therefrom to the bottom of an inner travel sheave 186 of the double sheave block 84(B). The cable 20 then wraps from the bottom to the top of inner travel sheave 186, and a variable length of cable 20(D) extends to its termination point 179, which is coupled to the end cap 82.

Detailed descriptions of the cable paths for cables 18 and 22 are not provided. The cable paths for cables 18 and 22 mirror the cable paths for cables 16 and 18, respectively, with the centerline 170 being the reflection plane. In one embodiment, the cable paths engage the outermost sheave and then work inward towards the centerline 170. Those skilled in the art recognize that other cable paths such as working from the inner sheaves to the outer sheaves are also possible and/or terminating cables on the travel member assembly 80. All such variations are intended to be within the embodiments of the invention.

When the distance between the travel member assembly 80 and the fixed end 48 is reduced, the lengths of the cables 16, 18, 20, and 22 extending upwardly from the support member 36 is increased, thereby lowering the support member. Since the cables 16, 18, 20, and 22 are simultaneously paid out or retracted by movement of the travel member assembly 80, the support member 36 will remain in its fixed attitude, usually in a horizontal attitude as it is being raised and lowered. In the embodiment illustrated, the self-climbing apparatus 12 climbs (or descends) 4 feet for every 1 foot the travel member assembly 80 is moved away from (or towards) the fixed end 48. Those skilled in the art recognize that other integer ratios of vertical displacement of the self-climbing apparatus 12 to the longitudinal displacement of the travel member assembly 80 are possible by changing the number of fixed and travel sheaves for each cable and by terminating the cables on the travel member assembly 80.

Vertically Aligned Sheaves

FIG. 9 illustrates an embodiment of the self-climbing stage lighting system 10 having a support spider 192 disposed in the support member 36. The spider support 190 is attached to the support member between the end cap 82 and the travel member assembly 80. The support member 192 includes a radial bearing 194 that receives the left end portion 78 of the travel screw 74 and supports the travel screw 74.

In addition, in this embodiment, sheaves are approximately vertically aligned, in that they rotate about horizontally extending axles. The motor end 46 of the support member 36 has two redirectional sheaves of which only 166 is shown. The redirectional sheaves are coupled to the support member 36 and extend partially outside of the support member 36 through an opening formed in the top wall 38. The redirectional sheave 166 bends cable 16 such that the cable is directed approximately longitudinally within the support member to the double sheave block 88(A) and approximately vertically from the support member 36. The cable 16 engages the double sheave blocks 88(A) and 88(B) in the manner previously described.

The other redirectional sheave (not shown) bends cable 18 such that the cable is directed approximately longitudinally within the support member 36 to the double sheave block 90(A) (not shown) and approximately vertically from the support member 36. The cable 18 engages the double sheave blocks 90(A) and 90(B).

In this embodiment, an outer fixed sheave 188 is vertically offset from an inner fixed sheave 190 at the fixed end 48. The outer fixed sheave 188 extends at least partially through the top wall 38 and directs the cable 20 towards the double sheave block 84(B). Functionally, outer fixed sheave 188 and inner fixed sheave 190 operate identically to the sheaves 180 and 184 of the double sheave block 84(A). Consequently, the sheaves 188 and 190 operate as an offset double sheave block in which cable 20 engages the double sheave block 84(B). The cable path of cable 20 is such that it works from the outermost sheaves inward toward the centerline 170.

Cross Mounted Sheaves

Figure 10:
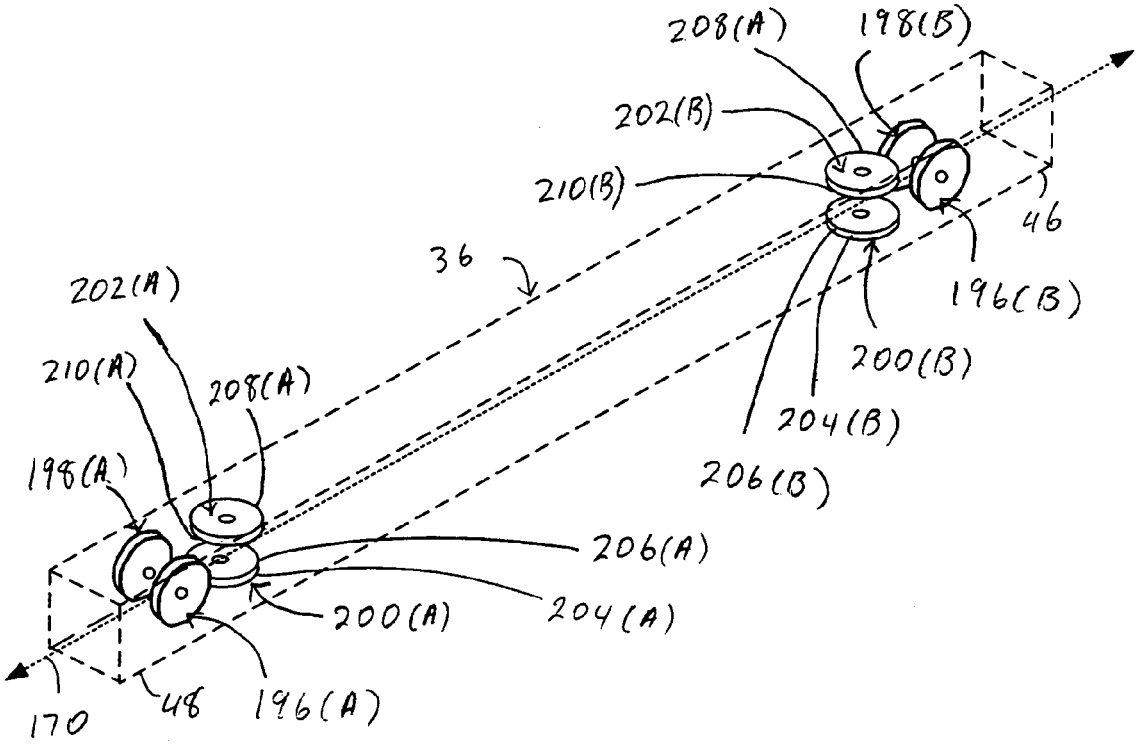
FIG. 10 is a perspective view of cross mounted stationary double sheave blocks and travel double sheave blocks.

FIG. 10 illustrates another embodiment of the self-claiming stage light system 10 in which double sheave blocks are cross mounted and longitudinally offset. Proximal to the fixed end, a pair of fixed double sheave blocks 196(A) and 198(A) are mounted vertically. A matching pair of vertically mounted travel double sheave blocks 196(B) and 198(B) are mounted to the travel member assembly 80 (not shown). The vertical fixed double sheave blocks 196(A) and 196(B) engage the cable 20 (not shown) as previously described with respect to double sheave blocks 84(A) and 84(B); and the vertical fixed double sheave blocks 198(A) and 198(B) engage the cable 22 (not shown) as previously described with respect to double sheave blocks 86(A) and 86(B).

A pair of horizontally aligned fixed double sheave blocks 200(A) and 202(A) are mounted proximal to the vertically aligned fixed double sheave blocks 196(A) and 198(A) between the vertically aligned fixed double sheave blocks 196(A) and 198(A) and the travel member assembly 80 (not shown). A matching pair of horizontally aligned travel double sheave blocks 200(B) and 202(B) are mounted proximal to the vertically aligned travel double sheave blocks 196(B) and 198(B) between the vertically aligned travel double sheave blocks 196(B) and 198(B) and the fixed end 48. The fixed double sheave blocks 200(A) and 200(B) each include an outer fixed sheave 204(A) and 204(B), respectively, and an inner fixed sheave 206(A) and 206(B), respectively. The travel double sheave blocks 202(A) and 202(B) are similarly configured to include an outer travel sheave 208(A) and 210(B), respectively, and an inner travel sheave 208(A) and 210(B), respectively.

In this embodiment, the redirectional sheave 166 (not shown) directs cable 16 (not shown) towards the horizontally fixed double sheave block 200(A). The cable 16 (not shown) wraps around the outer fixed sheave 204(A) and is directed towards the outer travel sheave 204(B). The cable 16 wraps around outer travel sheave 204(B) and is directed to inner fixed sheave 206(A) where it is redirected to inner travel sheave 206(B). After wrapping around inner travel sheave 206(B), the cable terminates proximal the fixed end 48.

Another motor end redirectional sheave (not shown) engages the cable 18 (not shown), and directs the cable to the horizontally aligned double sheave block 202(A). The horizontally aligned double blocks sheaves 202(A) and 202(B) cooperate to engage cable 18 in a manner similar to which cable 16 is engaged by double sheave blocks 200(A) and 200(B).

As those skilled in the art will recognize, an advantage of having longitudinally offset and cross mounted sheave blocks is that each sheave can have a greater diameter than when the sheaves are not longitudinally offset and cross mounted. For example, in the embodiment where the double sheave blocks are vertically aligned, each sheave in the double sheave blocks must be less than one-half the height of the front and back sidewalls 42 and 44, respectively. Thus, with longitudinally offset and cross mounted sheaves, it is possible to employ larger sheaves without increasing the cross sectional size of the support member 36. As known by those skilled in the art, larger diameter sheaves are needed with increased cable diameter so as to maintain the diameter ratio of the sheave to cable within the desired range of 28-32:1.

Although preferred embodiments of the invention has been disclosed in detail herein, it will be obvious to those skilled in the art that variations and modifications of the disclosed embodiments can be made without departing from the spirit and scope of the invention as set forth in the following claims. For example, in another embodiment, stationary sheaves can be disposed between the screw jack transmission and the travel member assembly such that self-climbing apparatus will ascend the cables as the travel member assembly is moved away from the screw jack transmission

We claim:

1. A self-climbing apparatus comprising:

a support member having a longitudinal length defined by a first end and an opposed second end;

a first cable at said first end of the support member and a second cable at said second opposed end of the support member, said first and second cables each including an upwardly extending run for connection to a higher structure and each cable including longitudinal runs extending along the length of the support member;

a linear drive mechanism coupled to the support member;

a traveling member carried by said support member and operatively connected to the longitudinal runs of the cables and coupled to the linear drive mechanism, the traveling member adapted to traverse a portion of the longitudinal length of the support member in response to an impulse from the linear drive mechanism, wherein in response to the traveling member moving towards one of the ends of the support member the upwardly extending runs of the cables are shortened, and in response to the traveling member moving towards the other end of the support member the upwardly extending runs of the cables are lengthened.

2. The apparatus of claim 1, further including:

a redirectional sheave for each cable coupled to the support member, the redirectional sheaves adapted to engage each cable in an approximately vertical orientation and redirect a portion of the cable in a direction that is approximately aligned with the longitudinal length of the support member.

3. The apparatus of claim 1, wherein the linear drive mechanism comprises a travel screw extending along a portion of the length of the support member having helical threads operatively engaging the travel member, and a motor mounted on the support member for rotating the travel screw.

4. The apparatus of claim 1, and further including:

a first and second sheave coupled to the support member proximal to the second end of the support member; and a redirectional sheave coupled to the support member proximal to the first end of the support member, wherein the redirectional sheave is adapted to direct a first portion of the first cable to the first sheave, and the first sheave directs a second portion of the first cable to the traveling member.

5. The apparatus of claim 4, wherein the first portion and the second portion of the first cable are approximately aligned with the longitudinal length of the support member.

6. The apparatus of claim 4, wherein the first and second cables have ends that are coupled to the traveling member.

7. The apparatus of claim 4, wherein the first and second cables have ends that are coupled to points that are stationary relative to the traveling member.

8. The apparatus of claim 4, further including:

an end cap mounted to the first end of the support member, the end cap having the linear drive mechanism mounted thereon.

9. The apparatus of claim 4, further including:

an end cap mounted to the second end of the support member, the end cap having the first and second sheaves fixedly attached thereto.

10. A self-climbing stage light support comprising:

an elongated support member for mounting objects above a stage, said support member including opposed right and left end portions, a pair of left stationary sheaves rotatably supported at said left end portion of said support member, a right stationary sheave rotatably supported at said right end portion of said support member, a pair of movable sheaves positioned between said pair of left stationary sheaves and said right stationary sheave, a linear actuator mounted on said support member for progressively moving said movable sheaves along a length of said support member, a left cable having an upward terminal end for connection to a higher support and extending downwardly and then about one of said left sheaves and along a portion of the length of said support and then about one of said movable sheaves and then approximately horizontally to a fixed connection on said support member, a right cable having an upward terminal end for connection to a higher support and extending downwardly and then about said right sheave and then along said support and then about the other one of said left sheaves and approximately horizontally about the other one of said movable sheaves and then approximately horizontally to a fixed connection on said support member, whereby in response to the movement of said pair of moveable sheaves by said linear actuator the left and right cables are simultaneously retracted or extended with respect to said support member to elevate or lower the support member.

11. The self-climbing stage light support of claim 10, wherein said linear actuator comprises a travel screw extending along the length of said elongated support having helical threads operatively engaging said movable sheaves, and a motor mounted on said support member for rotating said travel screw.

12. The self-climbing stage light support of claim 10, wherein except for the stationary right sheave, the sheaves that engage the right cable are approximately horizontally aligned.

13. The self-climbing stage light support of claim 10, wherein the sheaves that engage the left cable are rotatably offset.

14. A self-climbing stage light support comprising:

an elongated support member having opposed end portions, stationary end sheaves supported at each end portion of said support member, a cable at each end portion of said support member, each said cable having upward terminal end for connection to a higher support and extending downwardly to the respective end portion of said support member and about said stationary end sheaves and along a length of said support member, a linear actuator mounted to said support member and operatively connected to said cables and configured to simultaneously retract both said cables with respect to said support member to lift the support member or to simultaneously extend said cables with respect to said support member to lower the support member.

15. The self-climbing stage light support of claim 14, wherein said linear actuator comprises a travel screw and travel sheaves movable by said travel screws along a length of said support member that provide a M to 1 ratio of movement of said travel sheaves to the movement of said support member along said cables that extend from the end portions of said support member, where M is an integer.

16. The self-climbing stage light support of claim 15, wherein M equals 4.

17. The self-climbing stage light support of claim 14, wherein said elongated support member comprises a tubular housing surrounding said linear actuator.

18. The self-climbing stage light support of claim 17, further including:

a motor mounted on said support member for rotating said travel screw.

19. The self-climbing stage light support of claim 18, wherein said travel screw is configured to avoid movement of said cables upon failure of said travel screw.

20. The self-climbing stage light support of claim 14, further including:

means for elongating portions of said cables along a length of the support member.

21. The self-climbing stage light support of claim 20, wherein said elongating means comprises a plurality of travel sheaves movable by the linear actuator, wherein said cables extend approximately longitudinally along a portion of the length of the support member and engage said stationary end sheaves.

22. The self-climbing stage light support of claim 21, wherein at least one travel sheave and at least one stationary sheave are aligned approximately parallel to a first direction, wherein at least one other travel sheave and at least one other stationary sheave are aligned approximately parallel to a second direction, wherein the first and second directions are approximately perpendicular.

23. The self-climbing stage light support of claim 22, wherein said at least one travel sheave and said at least one stationary sheave aligned approximately parallel to the first direction are longitudinally offset from said at least one other travel sheave and said at least one other stationary sheave approximately aligned parallel to the second direction.

24. The self-climbing stage light support of claim 22, wherein said at least one travel sheave and said at least one stationary sheave aligned approximately parallel to the first direction are rotatably offset.

* * * * *